US009762989B2

(12) United States Patent
Shin

(10) Patent No.: US 9,762,989 B2
(45) **Date of Patent: *Sep. 12, 2017**

(54) EARSET

(71) Applicant: Haebora Co., Ltd., Seoul (KR)

(72) Inventor: Doo Sik Shin, Seoul (KR)

(73) Assignee: Haebora Co., Ltd., Seoul (KR)

( * ) Notice: Subject to any disclaimer, the term of this patent is extended or adjusted under 35 U.S.C. 154(b) by 11 days.

This patent is subject to a terminal disclaimer.

(21) Appl. No.: 14/837,332

(22) Filed: Aug. 27, 2015

(65) Prior Publication Data

US 2016/0302000 A1 Oct. 13, 2016

(30) Foreign Application Priority Data

Apr. 10, 2015 (KR) ..... 10-2015-0050805

(51) Int. Cl.
*H04R 1/10* (2006.01)

(52) U.S. Cl.
CPC ..... *H04R 1/1016* (2013.01); *H04R 1/1075* (2013.01); *H04R 1/1083* (2013.01); *H04R 2201/107* (2013.01)

(58) Field of Classification Search
CPC ..... H04R 1/1016; H04R 1/1091; H04R 3/02; H04R 2201/107
See application file for complete search history.

(56) References Cited

U.S. PATENT DOCUMENTS 7,983,433 B2 * 7/2011 Nemirovski ..... H04R 1/1016 381/151
9,167,337 B2 * 10/2015 Shin ..... H04R 3/02
9,473,842 B2 * 10/2016 Shin ..... H04R 1/1016
2008/0226090 A1 * 9/2008 Seto ..... H04R 3/02 381/66
2014/0226832 A1 * 8/2014 Shimizu ..... H04R 1/1016 381/74
2014/0233749 A1 * 8/2014 Shimizu ..... H04R 1/1083 381/71.6
2015/0023542 A1 * 1/2015 Shimizu ..... H04R 1/1075 381/380

(Continued)

*Primary Examiner* — Matthew Eason
(74) *Attorney, Agent, or Firm* — Hammer & Associates, P.C.

(57) ABSTRACT

Disclosed is an earset. The earset includes: a case that forms an appearance thereof; an ear pad that is mounted in an end portion of the case, forms a communication hole communicating with a user's external auditory canal, and is attached to/detached from a user's ears; and a soundproof housing that is received in the case, and includes a speaker output hole for transmitting sound generated from a speaker to the communication hole of the ear pad, a microphone input hole for transmitting the sound transmitted from the user's ears to the communication hole of the ear pad to a microphone, a speaker accommodating groove for accommodating the speaker while communicating with the speaker output hole, a microphone accommodating groove for accommodating the microphone while communicating with the microphone input hole, and one or more back holes for allowing a part of sound flowing into the microphone input hole to flow into a rear surface of the microphone accommodated in the microphone accommodating groove while communicating with the microphone input hole.

6 Claims, 12 Drawing Sheets

(56) References Cited

U.S. PATENT DOCUMENTS

| | | | | |
|---|---|---|---|---|
| 2015/0055810 | A1* | 2/2015 | Shin | H04R 1/1083<br>381/332 |
| 2015/0341718 | A1* | 11/2015 | Shin | H04R 3/02<br>381/66 |
| 2015/0350759 | A1* | 12/2015 | Shin | H04R 3/02<br>381/58 |
| 2016/0142806 | A1* | 5/2016 | Lee | H04R 1/1075<br>381/375 |

* cited by examiner

EARSET

CROSS-REFERENCE TO RELATED APPLICATION

This application claims priority to and the benefit of Korean Patent Application No. 2015-0050805, filed on Apr. 10, 2015, the disclosure of which is incorporated herein by reference in its entirety.

BACKGROUND

1. Field of the Invention

The present invention relates to an earset, and more particularly, to an earset that may increase the sound volume input to a microphone, and reduce a diameter of a front case so that the front case may be easily inserted into a user's ears.

2. Discussion of Related Art

In general, an earset is a voice transmission and reception device in which an earphone (speaker) and a microphone (mike) are combined, and is connected to an electronic device such as an MP3 player, a mobile phone, or the like in a wired or wireless manner, so that sounds such as sound, voice, and the like are transmitted and received via a user's ears and mouth.

Such an earset is roughly classified into a separation type earset in which a speaker for transmitting sound is inserted into a user's ears and a microphone is arranged in the vicinity of a user's mouth, and an integration type earset in which the speaker and the microphone are both inserted into the user's ears.

In the case of the separation type earset, the speaker and the microphone are positioned to be separated from each other, so that there is convenience that a user can listen to music or make a call while both hands are free. However, when the user is positioned in a noisy place or moves his or her body, the speaker inserted into the user's ears is removed from the user's ears or the position of the microphone is shaking, and therefore sound cannot be accurately transmitted.

Whereas, in the case of the integration type earset, an ear pad inserted into the external auditory canal is mounted and the speaker and the microphone are both inserted into the user's ears, so that sound can be accurately transmitted even in the noisy place, when compared to the separation type earset.

As the prior art of such an integration type earset, an earset which has been filed as a patent application (dated on Mar. 29, 2012) by the present applicant and publication-registered (dated on Dec. 12, 2013) is disclosed in Korean Patent Registration No. 10-1341308.

However, in such a conventional earset, the speaker and the microphone are accommodated and arranged to be parallel to each other with respect to an axial line of the ear pad. In addition, as to the conventional earset, in a front housing coupled to a front end of a rear housing in which the speaker and the microphone are accommodated, a single speaker output hole for outputting sound generated from the speaker is provided, a single microphone input hole for transmitting sound transmitted from the user's ears to the microphone, and a pair of back holes are provided. The speaker output hole, the microphone input hole, and the back hole may be formed to be independently separated from one another.

Thus, in the conventional earset, a partition wall for shutting off the microphone input hole from the pair of back holes is required to be formed so that the single microphone input hole and the pair of back holes may be implemented to be independently separated from each other in the front housing, and therefore the utilization of the space of the front housing is limited, that is, the sizes of the microphone input hole and the back hole are limited, whereby the sound volume flowing into the microphone is reduced and there are difficulties in the insertion of the front case of the earset into the user's ears due to an increased diameter of the front case.

PRIOR ART DOCUMENT

Patent Document 1

Korean Patent Registration No. 10-1341308 (Title of the invention: Soundproof housing for earset and wired/wireless earset having the same, published on Dec. 12, 2013)

SUMMARY OF THE INVENTION

The present invention is directed to an earset which may improve the arrangement of a microphone input hole and a back hole and may thereby increase the sound volume flowing into the microphone, and reduce a diameter of a front case so that the front case is easily inserted into a user's ears.

According to an aspect of the present invention, there is provided an earset including: a case that forms an appearance thereof; an ear pad that is mounted in an end portion of the case, forms a communication hole communicating with a user's external auditory canal, and is attached to/detached from a user's ears; and a soundproof housing that is received in the case, and includes a speaker output hole for transmitting sound generated from a speaker to the communication hole of the ear pad, a microphone input hole for transmitting the sound transmitted from the user's ears to the communication hole of the ear pad to a microphone, a speaker accommodating groove for accommodating the speaker while communicating with the speaker output hole, a microphone accommodating groove for accommodating the microphone while communicating with the microphone input hole, and one or more back holes for allowing a part of sound flowing into the microphone input hole to flow into a rear surface of the microphone accommodated in the microphone accommodating groove while communicating with the microphone input hole.

Here, the back hole may be partially recessed on an inner circumference of the microphone accommodating groove.

Also, the soundproof housing may be detachably coupled to a front housing and a rear housing, the speaker output hole and the microphone input hole may be formed in the front housing, and the speaker accommodating groove, the microphone accommodating groove, and the back hole may be formed in the rear housing.

Also, the speaker accommodating groove and the microphone accommodating groove may be formed to be parallel to each other or to be deviated with respect to a center line of the rear housing.

Also, the speaker output hole and the microphone input hole may be formed to be independently separated from each other, and the speaker accommodating groove and the microphone accommodating groove may be formed to be independently separated from each other.

Also, the earset may further include: a filter that is disposed in front of the speaker output hole and the microphone input hole while facing the communication hole, and prevents external foreign substances from flowing into the speaker output hole and the microphone input hole. Here, the case may be mounted in a cradle, and then a battery for providing power to the microphone may be charged by applying a power source having a different polarity to the filter and the case.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
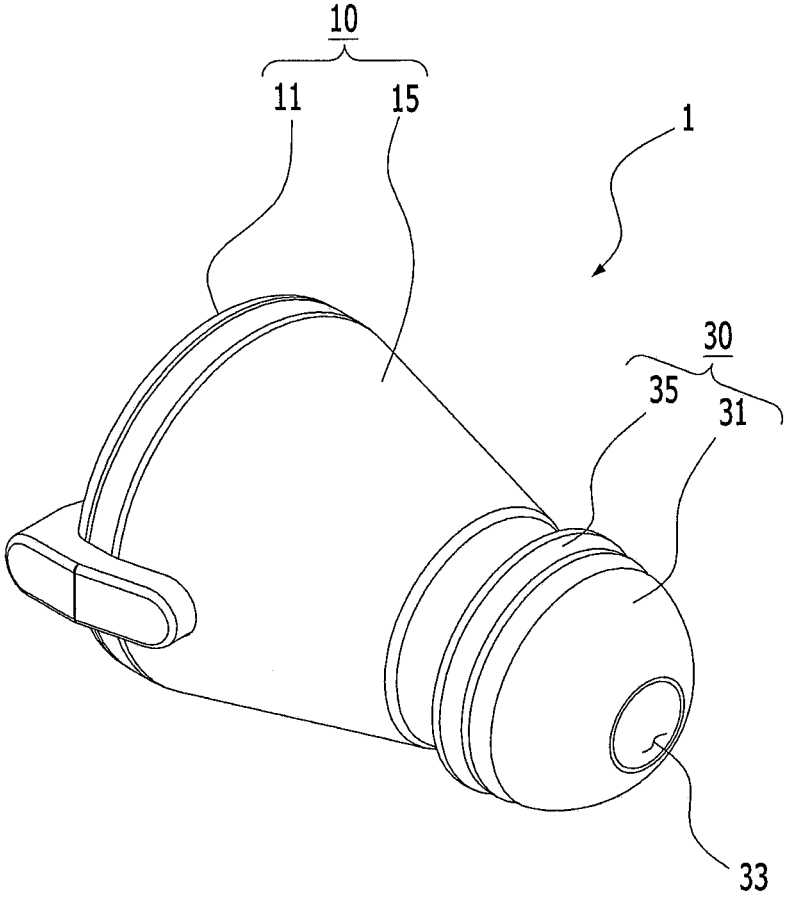
FIG. 1 is a perspective view showing an earset according to a first embodiment of the present invention.
Figure 2:
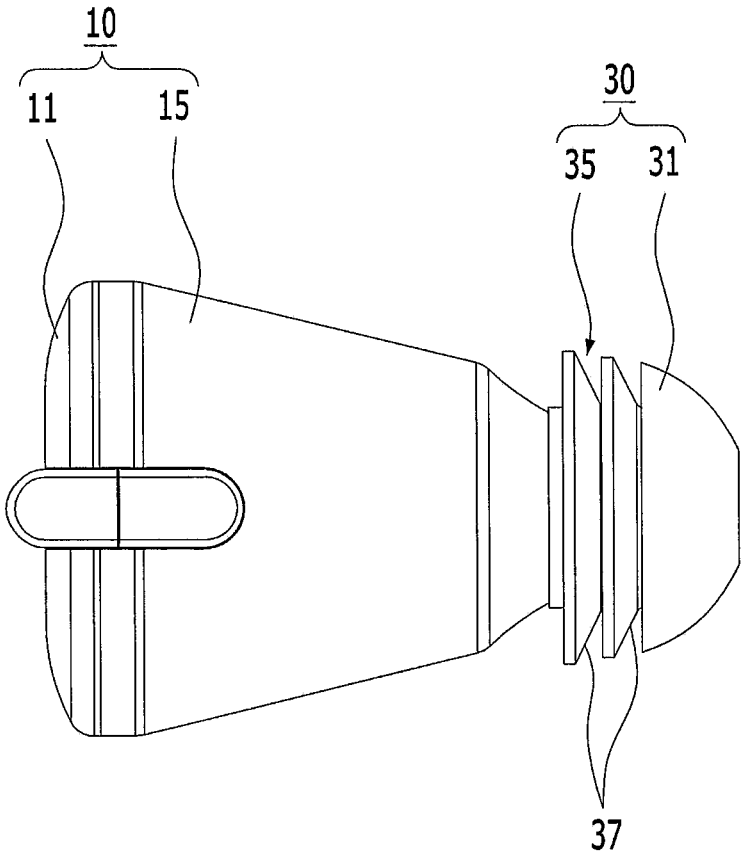
FIG. 2 is a front view of FIG. 1.

Hereinafter, embodiments of the present invention will be described in detail with reference to the accompanying drawings.

Prior to description, an earset in the following description refers to a device that is configured in such a manner that a speaker and a microphone are integrally formed and is inserted into a user's ears, and may be applied to an earphone for listening to music, a wired ear microphone, a Bluetooth headset, a Wi-Fi headset, an NFC (Near Field Communication) headset, a binary CDMA headset, and a voice search or voice control headset.

In addition, in various embodiments, like reference numerals in the drawings denote like elements, and they will be representatively described in a first embodiment and only different configurations from those of the first embodiment will be described in other embodiments.

In FIGS. 1 to 6, an earset according to a first embodiment of the present invention is shown. As shown in FIGS. 1 to 6, an earset 1 according to an embodiment of the present invention includes a case 10, an ear pad 30, and a soundproof housing 40.

The case 10 forms the overall appearance of the earset 1. The case 10 forms a receiving space for receiving the soundproof housing 40 therein, has a protrusion portion 21 to which the ear pad 30 is coupled, and includes a rear case 11 and a front case 15.

The rear case 11 is a portion that forms the appearance of the rear side of the earset 1, and is coupled to a rear end portion of the front case 15. A charging terminal 85 for supplying power to a battery 81 which will be described below is provided behind the rear case 11.

The front case 15 has a hollow truncated cone shape as a whole, and includes a front case main body 17 that is detachably coupled to the rear case 11 and the protrusion portion 21 that protrudes from an end portion of the front case main body 17 by a predetermined length so that the protrusion portion 21 can be inserted into a user's ears. The inside of the front case main body 17 and the inside of the protrusion portion 21 communicate with each other. That is, the front case main body 17 and the protrusion portion 21 may be integrally formed to have a single large hole that is penetratingly formed. The soundproof housing 40 and the battery 81 are received in such a front case 15.

Figure 3:
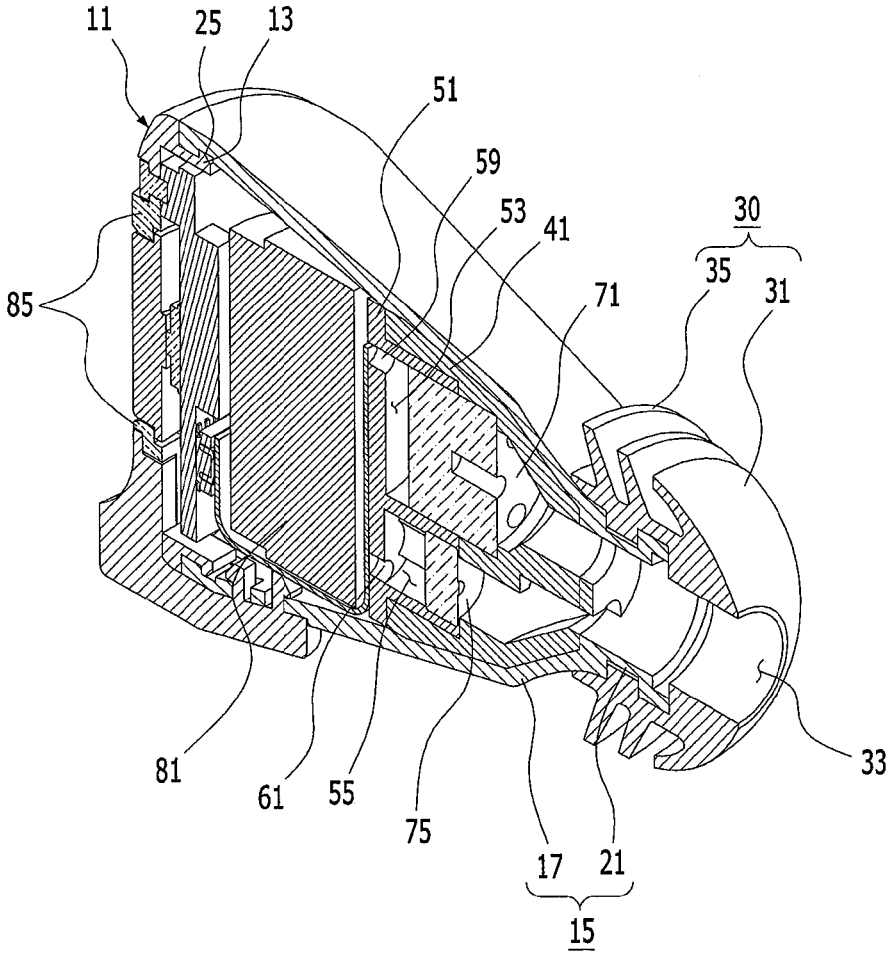
FIG. 3 is a longitudinal cross-sectional view of FIG. 1.
Figure 4:
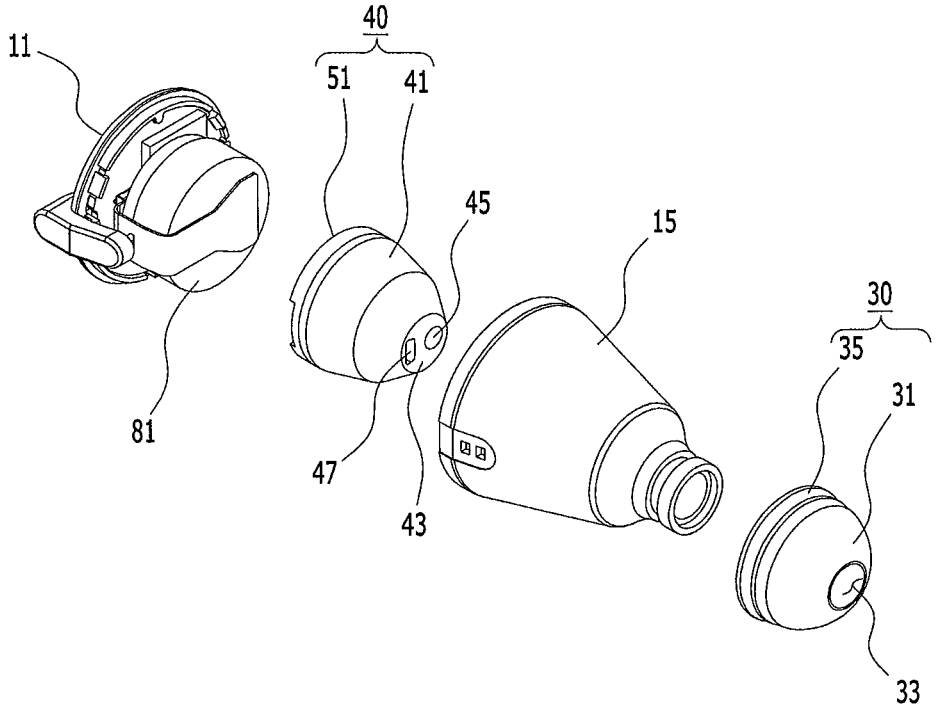
FIG. 4 is an exploded perspective view of FIG. 1.
Figure 5:
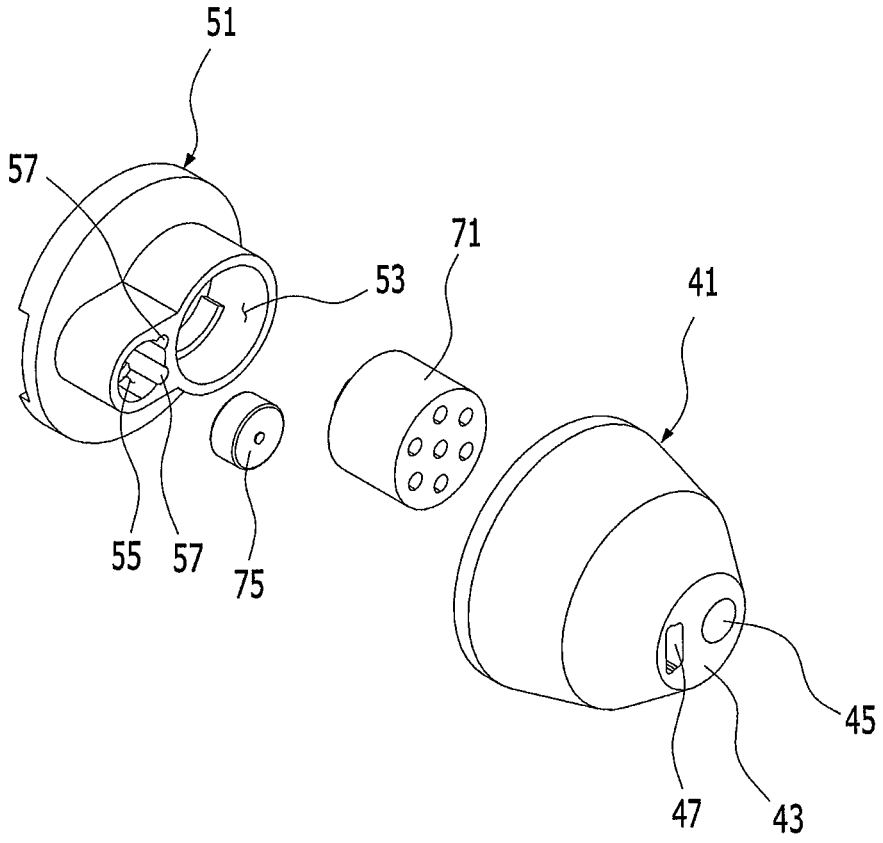
FIG. 5 is an exploded perspective view showing a front housing and a rear housing of FIG. 4.
Figure 6:
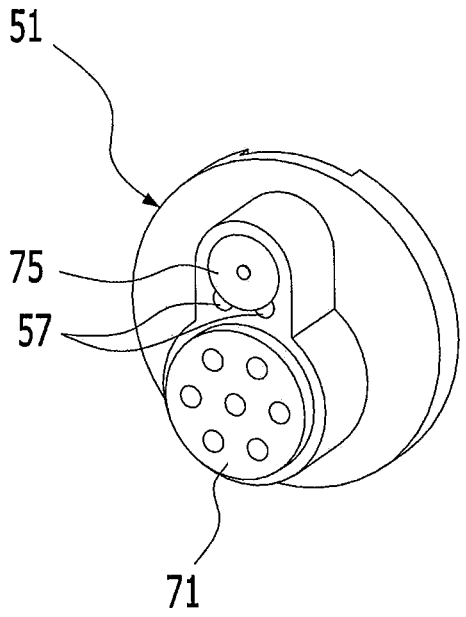
FIG. 6 is a perspective view showing a state in which a speaker and a microphone are assembled in the rear housing of FIG. 5.
Figure 7:
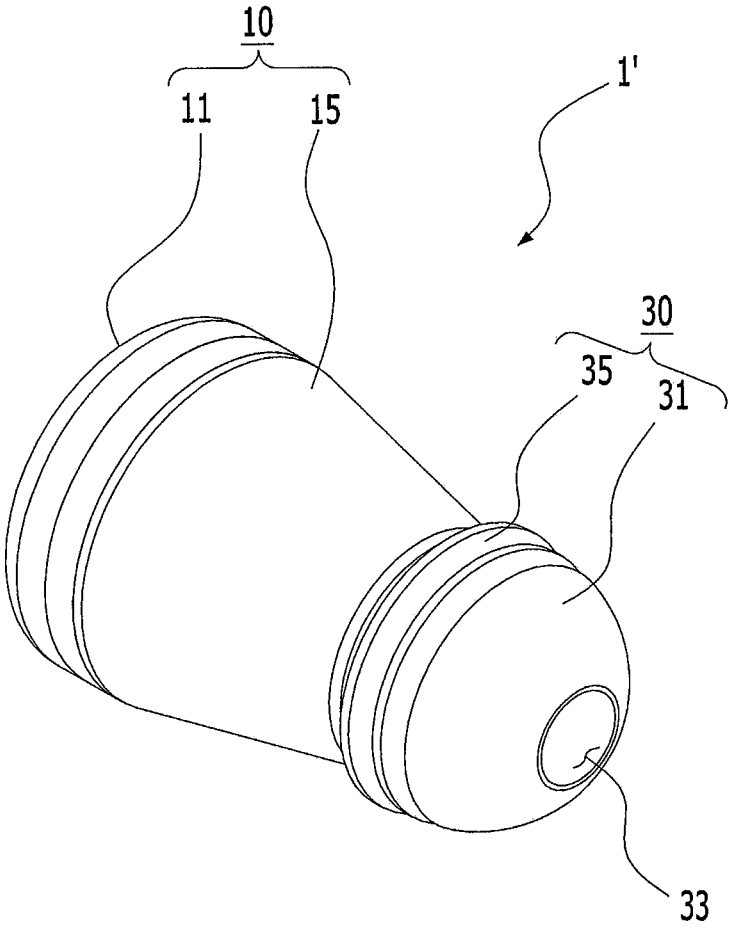
FIG. 7 is a perspective view showing an earset according to a second embodiment of the present invention.
Figure 8:
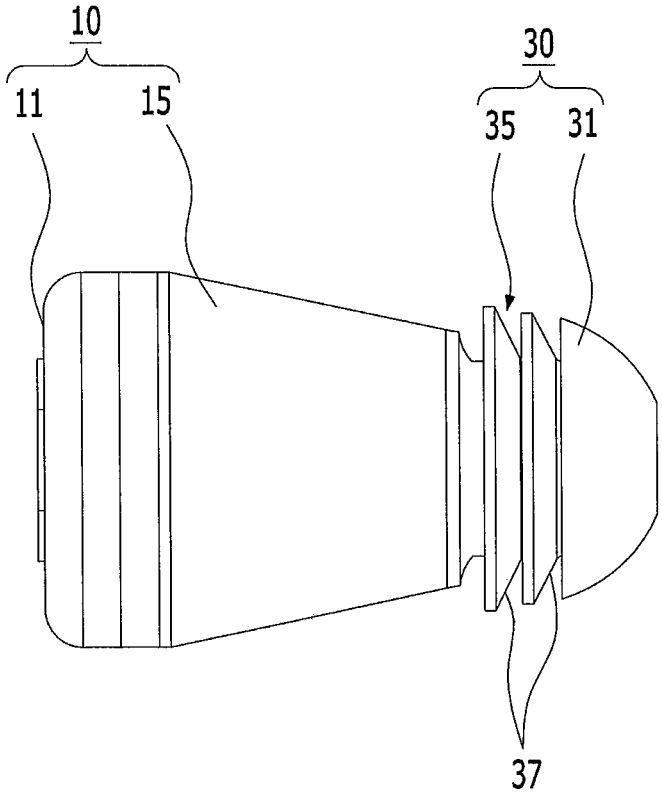
FIG. 8 is a front view of FIG. 7.
Figure 9:
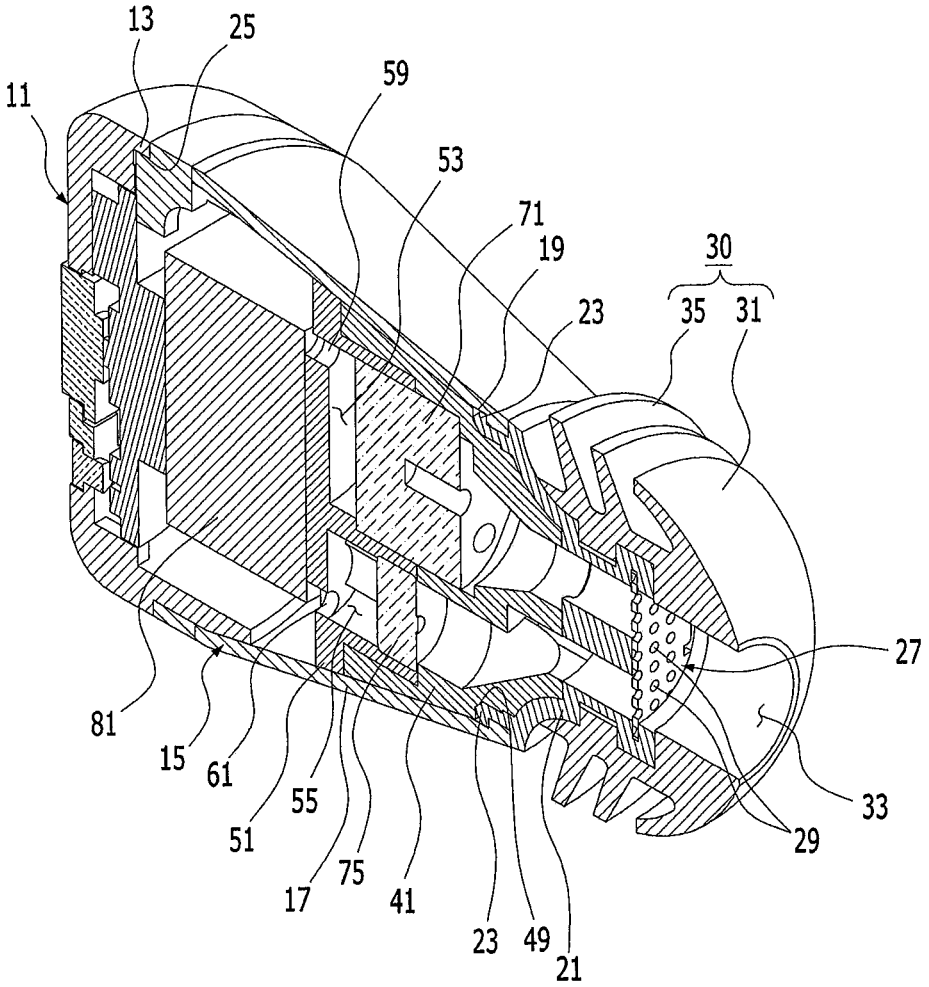
FIG. 9 is a longitudinal cross-sectional view of FIG. 7.
Figure 10:
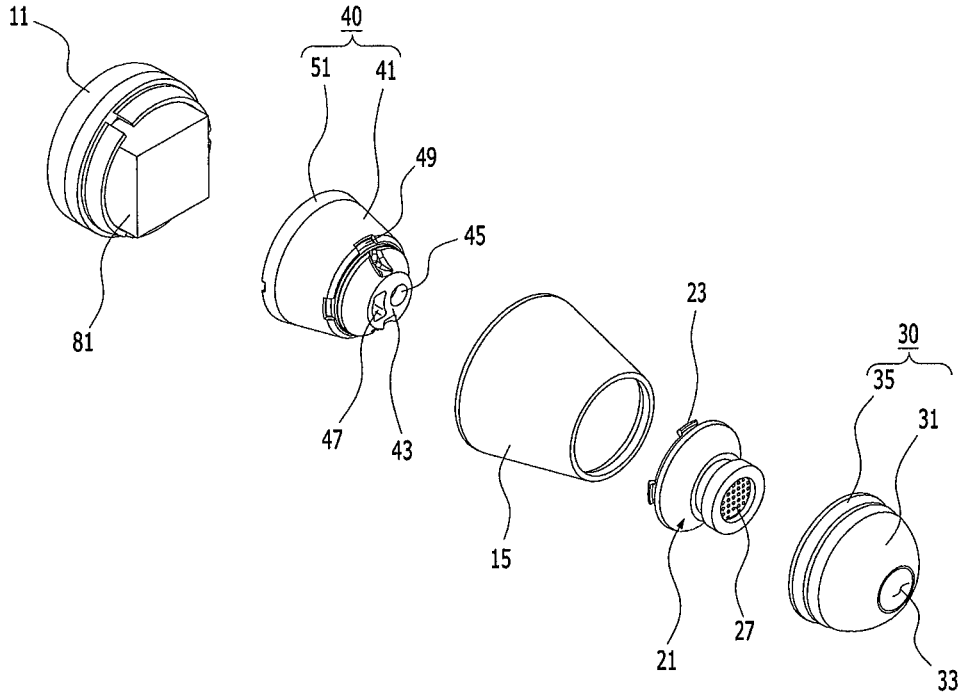
FIG. 10 is an exploded perspective view of FIG. 7.
Figure 11:
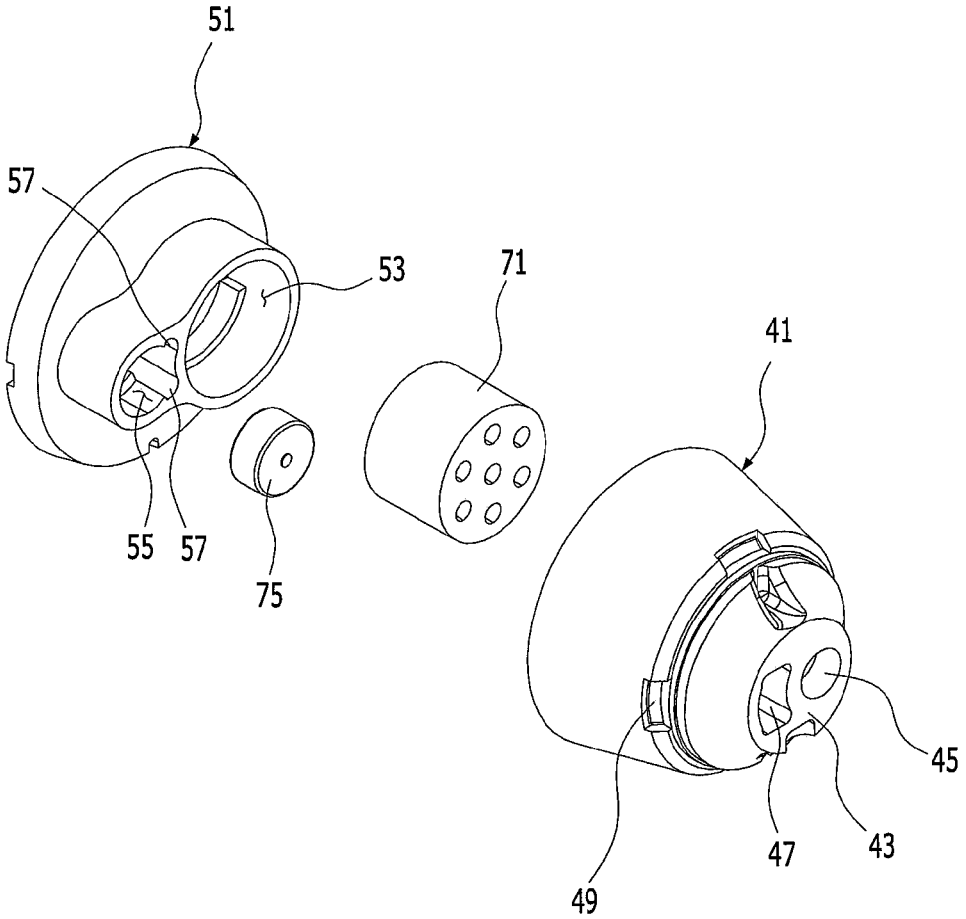
FIG. 11 is an exploded perspective view showing a front housing and a rear housing of FIG. 10.
Figure 12:
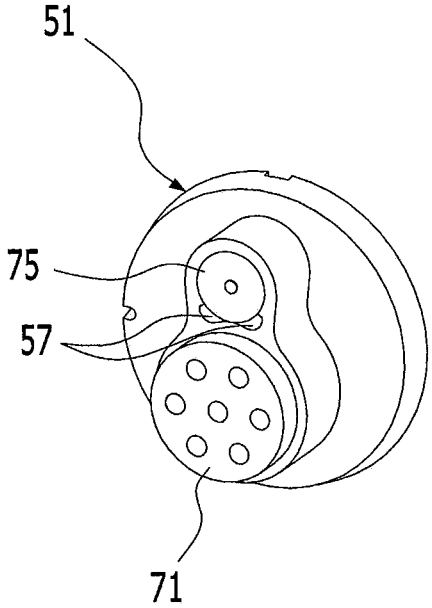
FIG. 12 is a perspective view showing a state in which a speaker and a microphone are assembled in the rear housing of FIG. 11.

Meanwhile, the rear case 11 and the front case 15 may be forcibly fitted to each other while keeping the airtightness. According to an embodiment, as shown in FIG. 3, a fitting jaw 13 is protrusively formed in an outer circumference of the end portion of the rear case 11 facing the front case 15, and a fitting groove 25 to which the fitting jaw 13 of the rear case 11 is forcibly fitted is formed in an inner circumference of the end portion of the front case 15 facing the rear case 11.

The ear pad 30 is mounted in the protrusion portion 21 of the front case 15, forms a communication hole 33 communicating with a user's external auditory canal, and allows the front case 15 to be easily inserted into the user's ears. The ear pad 30 may be made of a material of any one of silicone, synthetic resin, and rubber which are elastically deformable, so that the ear pad 30 is brought into contact with the user's external auditory canal in an elastic manner.

Such an ear pad 30 includes an ear pad body 31 and a plurality of treads 35.

The ear pad body 31 has a shape in which a distal end portion of the ear pad body 31 is partially cut, for example, a truncated semi-circular cross-sectional shape, so that the ear pad body 31 can be easily inserted into the user's external auditory canal. The ear pad body 31 is coupled to the protrusion portion 21 of the front case 15, and the communication hole 33 that communicates with a speaker output hole 45 and a microphone input hole 47 of the soundproof housing 40, which will be described below, is formed inside the ear pad body 31. The communication hole 33 serves to transmit the sound generated from a speaker 71 to the user's external auditory canal. In addition, the sound transmitted from the user's ears to the communication hole 33 is transmitted to a microphone 75. Here, the ear pad body 31 is illustrated to have the truncated semi-circular cross-sectional shape, but is not limited thereto. For example, the ear pad body 31 may have a truncated elliptical cross-sectional shape.

The plurality of treads 35 has a ring shape, and are formed at an interval on an outer peripheral surface of the opposite end portion of the distal end portion of the ear pad body 31. The plurality of treads 35 has an inclined portion 37 that is downwardly inclined in an insertion direction in which the ear pad 30 is inserted into the external auditory canal with respect to an axial line of the communication hole 33 of the ear pad body 31. Thus, the treads 35 have a triangular cross-sectional shape as a whole. As a result, the ear pad 30 may be easily inserted into the external auditory canal, and the movement of the ear pad 30 may be suppressed by friction between the treads 35 and an inner wall of the external auditory canal, thereby providing a comfortable and stable wearing sensation.

In addition, the plurality of treads 35 has a cross-sectional shape in which the outer diameter is gradually increased toward the case 10. That is, the plurality of treads 35 has a cross-sectional shape in which the diameter is gradually increased in a direction opposite to the insertion direction into the external auditory canal. Accordingly, when the earset 1 is mounted in the external auditory canal, adhesion between the treads 35 and the inner wall of the external auditory canal is more enhanced, so that external noise may be shielded from flowing into the external auditory canal and the ear pad 30 may be wearable regardless of the size of the external auditory canal, whereby the user's convenience is increased.

Here, the cross-sectional shape of the treads 35 may have various cross-sectional shapes other than a triangular cross-sectional shape. The plurality of treads 35 may have the same outer diameter.

Meanwhile, the soundproof housing 40 is received in the case 10, so that the sound generated from the speaker 71 is transmitted to the ear pad 30 and the sound transmitted from the user's ears to the ear pad 30 is transmitted to the microphone 75. In addition, the soundproof housing 40 serves to block the inflow of external noise through the front case 15 or the rear case 11, and serves to reduce the occurrence of vibration noise caused by the speaker 71 and the microphone 75 to improve the sound quality.

The soundproof housing 40 is received in an inner receiving space of the case 10 in the form that a front housing 41 facing the ear pad 30 and a rear housing 51 facing the rear case 11 are combined. For example, the soundproof housing 40 is received in the inner receiving space of the rear case 11 and the front case 15.

The front housing 41 may be provided in one region of the inner receiving space of the front case 15 to protrude long toward the inside of the protrusion portion 21 of the front case 15. For example, in the front housing 41, an insertion protrusion portion 43 corresponding to the inner cross-sectional shape of the protrusion portion 21 of the front case 15 is formed.

In addition, in the front housing 41, a single speaker output hole 45 for outputting the sound generated from the speaker 71 and a single microphone input hole 47 for transmitting the sound transmitted from the user's ears to the communication hole 33 of the ear pad 30 to the microphone 75 are penetratingly formed.

The speaker output hole 45 and the microphone input hole 47 communicate with the communication hole 33 of the ear pad 30, and are formed to be independently separated from each other so that the sound from the speaker 71 is prevented from flowing into the microphone 75.

The speaker output hole 45 has a circular cross-sectional shape, and has a shape in which the cross-sectional area thereof is gradually increased toward the rear housing 51. Here, the speaker output hole 45 may have various cross-sectional shapes other than the circular cross-sectional shape.

Meanwhile, although not shown, a ring-shaped protrusion portion that protrudes toward the inside of the front case 15 along the periphery of the speaker output hole 45 may be formed in the insertion protrusion portion 43. By such a protrusion portion, the front housing 41 may be easily inserted into the front case 15 to be coupled in close contact with the front case 15, and therefore the front housing 41 may be completely in close contact with the front case 15, preventing an echo phenomenon that occurs due to defective assembly.

In addition, the microphone input hole 47 has a rectangular cross-sectional shape, and has a shape in which the cross-sectional area is gradually increased toward the rear housing 51. Here, the microphone input hole 47 may have various cross-sectional shapes other than the rectangular cross-sectional shape.

The rear housing 51 is coupled to an end portion of the front housing 41 to block the rear side of the front housing 41, and is received in the inner receiving space of the front case 15.

In the rear housing 51, a speaker accommodating groove 53 for accommodating the speaker 71 while communicating the speaker output hole 45, a microphone accommodating groove 55 for accommodating the microphone 75 while communicating the microphone input hole 47, and a pair of back holes 57 for allowing a part of sound flowing into the microphone input hole 47 to flow into a rear surface of the microphone 75 accommodated in the microphone accommodating groove 55 while communicating with the microphone input hole 47 are provided. Here, it is preferable that the microphone 75 be a directional microphone in which sound is input to the front and rear surfaces of the microphone 75. In addition, the speaker accommodating groove 53 and the microphone accommodating groove 55 are provided to be parallel to each other with respect to a center line of the rear housing 51, but the speaker accommodating groove 53 and the microphone accommodating groove 55 may be provided to be deviated with respect to the center line of the rear housing 51, for example, provided in forward/rearward directions with respect to the center line of the rear housing 51.

The speaker accommodating groove 53 is provided on one side of the rear housing 51 facing the front housing 41, and formed to be recessed by a predetermined depth while having a diameter corresponding to the diameter of the speaker 71.

In addition, the microphone accommodating groove 55 is provided on one side of the rear housing 51 facing the front housing 41, and formed to be recessed by a predetermined depth while having a diameter corresponding to the diameter of the microphone 75.

The speaker accommodating groove 53 and the microphone accommodating groove 55 respectively communicate with the speaker output hole 45 and the microphone input hole 47, and are formed to be independently separated from each other so that the sound from the speaker 71 is prevented from flowing into the microphone 75.

Each of the pair of back holes 57 has a semi-circular cross-sectional shape, and is formed to be partially recessed on an inner circumference of the microphone accommodating groove 55. The back hole 57 communicates with a bottom portion of the microphone accommodating groove 55 so that a part of the sound flowing into the microphone input hole 47 flows into the rear surface of the microphone 75 accommodated in the microphone accommodating groove 55. Here, according to the present embodiment, a case in which the pair of back holes 57 are provided is shown, but the present invention is not limited. For example, one or more back holes 57 may be provided. In addition, the back hole 57 may have various cross-sectional shapes other than the semi-circular cross-sectional shape.

Thus, a part of the sound flowing into the microphone input hole 47 flows into the rear surface of the microphone 75 through the pair of back holes 57 while most of the sound flowing into the single microphone input hole 47 flows into the front surface of the microphone 75 accommodated in the microphone accommodating groove 55.

Meanwhile, it is preferable that the soundproof housing 40 be made of a sound-absorbing material, plastics, rubbers, silicone, or the like, so that the ease of the assembly may be improved, noise from the outside may be blocked, and sound signals transmitted and received to and from the inside may be efficiently transmitted to the user's external auditory canal.

Meanwhile, the battery 81 is provided behind the rear housing 51 facing the rear case 11, and received into the front case 15. The battery 81 provides power to the microphone 75.

Here, a non-described reference numeral 59 indicates a speaker cable hole through which a cable for speaker (not shown) passes. The speaker cable hole 59 is penetratingly formed to communicate with the speaker accommodating groove 53 of the rear housing 51, so that the cable for speaker connected to the speaker 71 accommodated in the speaker accommodating groove 53 passes through the speaker cable hole 59. In addition, a non-described reference numeral 61 indicates a microphone cable hole through which a cable for microphone (not shown) passes. The microphone cable hole 61 is penetratingly formed to communicate with the microphone accommodating groove 55 of the rear housing 51, so that the cable for microphone connected to the microphone 75 accommodated in the microphone accommodating groove 55 passes through the microphone cable hole 61. Each of the cable holes 59 and 61 is sealed in the rear housing 51 by an adhesive or the like, so that the inflow of the external noise may be prevented.

By such a configuration, the earset according to the first embodiment of the present invention has a structure in which the ear pad 30 is coupled to the protrusion portion 21 of the front case 15 of the case 10 and the soundproof housing 40 is received inside the case 10.

In addition, the earset according to the first embodiment of the present invention has a structure in which the single speaker output hole 45 and the single microphone input hole 47 are formed in the front housing 41, the speaker accommodating groove 53 and the microphone accommodating groove 55 are formed in the rear housing 51, and the back hole 57 is formed along the inner circumference of the microphone accommodating groove 55.

Thus, the sound output from the speaker 71 accommodated in the rear housing 51 is transmitted to the ear pad 30 through the speaker output hole 45. In addition, a part of the sound flowing into the microphone input hole 47 flows into the rear surface of the microphone 75 through the back hole 57, while most of the sound flowing into the microphone input hole 47 from the ear pad 30 flows into the front surface of the microphone 75 accommodated in the microphone accommodating groove 55.

In this manner, the earset 1 according to the first embodiment of the present invention may improve the arrangement of the microphone input hole 47 and the back hole 57, that is, form the single speaker output hole 45 and the single microphone input hole 47 in the front housing 41 and form the back hole 57 in the inner circumference of the microphone accommodating groove 55, so that the sound volume flowing into the microphone 75 may be increased, and the sound flowing into the microphone 75 may not overlap with the sound output by the speaker 71. In addition, by reducing the diameter of the front case 15 of the earset 1, even a user having a relatively small external auditory canal may easily wear the earset 1.

In FIGS. 7 to 12, an earset according to a second embodiment of the present invention is shown. As shown in FIGS. 7 to 12, an earset 1' according to the second embodiment of the present invention has a structure in which the protrusion portion 21 of the front case 15 in which the ear pad 30 is mounted is detachably coupled to the front case main body 17, unlike the above-described first embodiment.

In addition, the earset 1' according to the second embodiment of the present invention has a structure in which the protrusion portion 21 of the front case 15 is hooked and coupled to the front case main body 17 and the front housing 41 of the soundproof housing 40.

In the protrusion portion 21 of the front case 15, a plurality of hooks 23 are formed to protrude at an interval so as to face the front housing 41, and in the front case main body 17 and the front housing 41, a plurality of hook coupling grooves 19 and 49 to which the plurality of hooks 23 of the protrusion portion 21 are hooked and coupled are formed.

In addition, in the protrusion portion 21 of the front case 15 of the earset 1' according to the second embodiment of the present invention, a filter 27 is provided. The filter 27 forms a plurality of through-holes 29 that communicates with the speaker output hole 45 and the microphone input hole 47, and is arranged in front of the speaker output hole 45 and the microphone input hole 47 so as to face the communication hole 33 of the ear pad 30.

The filter 27 prevents external foreign substances from flowing into the speaker output hole 45 and the microphone input hole 47.

Here, the filter 27 is made of a metal material having conductivity, and the case 10 is also made of a metal material having conductivity, so that the filter 27 may act as a charging terminal for charging the battery 81 together with the case 10. That is, the earset 1' according to the second embodiment of the present invention may be mounted in a dedicated cradle which is not shown, and then the battery 81 received in the earset 1' may be charged by applying power to the filter 27 and the case 10 so that the filter 27 and the case 10 have different polarities from each other.

By this configuration, in the same manner as that in the above-described first embodiment, the earset 1' according to the second embodiment of the present invention may improve the arrangement of the microphone input hole 47 and the back hole 57, so that the sound volume flowing into the microphone 75 may be increased, and the sound flowing into the microphone 75 may not overlap with the sound output by the speaker 71. In addition, by reducing the diameter of the front case 15 of the earset 1', even a user having a relatively small external auditory canal may easily wear the earset 1'. In addition, by reducing the overall size of the earset 1' and the overall size of the cradle in which the earset 1' is mounted, the earset 1' may be easily charged in the cradle.

Meanwhile, although not shown in the above-described embodiments, one or more tuning holes that communicate with at least any one of the speaker accommodating groove and the speaker output hole may be formed in the soundproof housing, so that the sound quality of the sound output from the speaker may be improved and the noise shielding performance of the microphone may be improved. In this manner, the tuning hole may be formed in the soundproof housing to secure a flow space of the air, for example, a vibrancy space of the sound through the tuning hole, so that the vibrancy of a vibration plate of the speaker is further increased. Accordingly, the sound output from the speaker, reaching from a low frequency band to a high frequency band, may be clearly and accurately transmitted to the ear pad, whereby the sound quality output from the speaker may be improved, and external noise may be prevented from flowing into the microphone to also improve the noise shielding performance of the microphone.

As described above, according to the embodiments of the present invention, the arrangement of the microphone input hole and the back hole may be improved and may thereby increase the sound volume flowing into the microphone, and reduce the diameter of the front case so that the front case may be easily inserted into the user's ears.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. An earset comprising:

a case that forms an appearance thereof;

an ear pad that is mounted in an end portion of the case, forms a communication hole communicating with a user's external auditory canal, and is attached to/detached from a user's ears; and a soundproof housing that is received in the case, and includes a speaker output hole for transmitting sound generated from a speaker to the communication hole of the ear pad, a microphone input hole for transmitting the sound transmitted from the user's ears to the communication hole of the ear pad to a microphone, a speaker accommodating groove for accommodating the speaker while communicating with the speaker output hole, a microphone accommodating groove for accommodating the microphone while communicating with the microphone input hole, and one or more back holes for allowing a part of sound flowing into the microphone input hole to flow into a rear surface of the microphone accommodated in the microphone accommodating groove while communicating with the microphone input hole.

2. The earset of claim 1, wherein the back hole is partially recessed on an inner circumference of the microphone accommodating groove.

3. The earset of claim 1, wherein the soundproof housing is detachably coupled to a front housing and a rear housing, the speaker output hole and the microphone input hole are formed in the front housing, and the speaker accommodating groove, the microphone accommodating groove, and the back hole are formed in the rear housing.

4. The earset of claim 3, wherein the speaker accommodating groove and the microphone accommodating groove are formed to be parallel to each other or to be deviated with respect to a center line of the rear housing.

5. The earset of claim 1, wherein the speaker output hole and the microphone input hole are formed to be independently separated from each other, and the speaker accommodating groove and the microphone accommodating groove are formed to be independently separated from each other.

6. The earset of claim 1, further comprising:

a filter that is disposed in front of the speaker output hole and the microphone input hole while facing the communication hole, and prevents external foreign substances from flowing into the speaker output hole and the microphone input hole, wherein the case is mounted in a cradle, and then a battery for providing power to the microphone is charged by applying a power source having a different polarity to the filter and the case.

* * * * *